United States Patent [19]

Stone

[11] Patent Number: 4,880,155

[45] Date of Patent: Nov. 14, 1989

[54] COLLAPSIBLE FOLDABLE DISPENSING CARTON

[75] Inventor: James L. Stone, Grand Rapids, Mich.

[73] Assignee: Packaging Corporation of America, Evanston, Ill.

[21] Appl. No.: 259,166

[22] Filed: Oct. 18, 1988

[51] Int. Cl.[4] ..... B65D 39/04

[52] U.S. Cl. ..... 229/125.09; 229/125.14; 229/125.15; 229/900

[58] Field of Search ..... 229/125.02, 125.08, 229/125.09, 125.14, 125.15, 125.17, 125.42, 131.1, 900, 917; 222/528, 556, 557, 559, 560

[56] References Cited

U.S. PATENT DOCUMENTS

| | | | |
|---|---|---|---|
| 393,899 | 12/1888 | Haines | 229/125.17 |
| 2,107,614 | 2/1938 | Kotcher et al. | 229/125.09 |
| 2,321,050 | 6/1943 | Seymer | 229/125.09 |
| 2,437,926 | 3/1948 | Ball et al. | 229/125.09 |
| 2,549,048 | 4/1951 | Bergstein | 229/125.09 |
| 3,250,436 | 5/1966 | Kurtz | 229/123.3 |
| 3,750,931 | 8/1973 | Dick | 229/917 |
| 3,981,432 | 9/1976 | Bergstein et al. | 229/125.17 |
| 4,732,315 | 3/1988 | Gunn | 229/125.09 |
| 4,770,325 | 9/1988 | Gordon et al. | 229/125.42 |
| 4,782,996 | 11/1988 | Spagni, Jr. | 229/125.09 |

*Primary Examiner*—Gary Elkins

*Attorney, Agent, or Firm*—Neuman, Williams, Anderson & Olson

[57] ABSTRACT

A collapsible foldable dispensing carton is provided having a pair of opposed first wall panels and a pair of opposed second wall panels foldably connected thereto. Each wall panel is provided with a top closure flap. The flaps are in overlapping relation when the carton is in a set up mode. One of the closure flaps is the outermost flap and has a dispensing opening formed therein. Another of the closure flaps subtending the outermost flap is provided with an aperture in registry with the dispensing opening when the flaps are in overlapping relation whereby the dispensing opening communicates with the carton interior. Mounted on the outermost flap is a fitment formed of thin material. The fitment includes a base section affixed to the exposed surface of the outermost flap circumjacent the dispensing opening, and a cover section adjustably mounted on the base section for movement between open and close positions. One of the top closure flaps, other than the outermost flap, is provided with a cutout in registry with the dispensing opening when the carton is in a collapsed mode whereby the collapsed carton has a substantially uniform thickness throughout.

4 Claims, 3 Drawing Sheets

FIG. 1
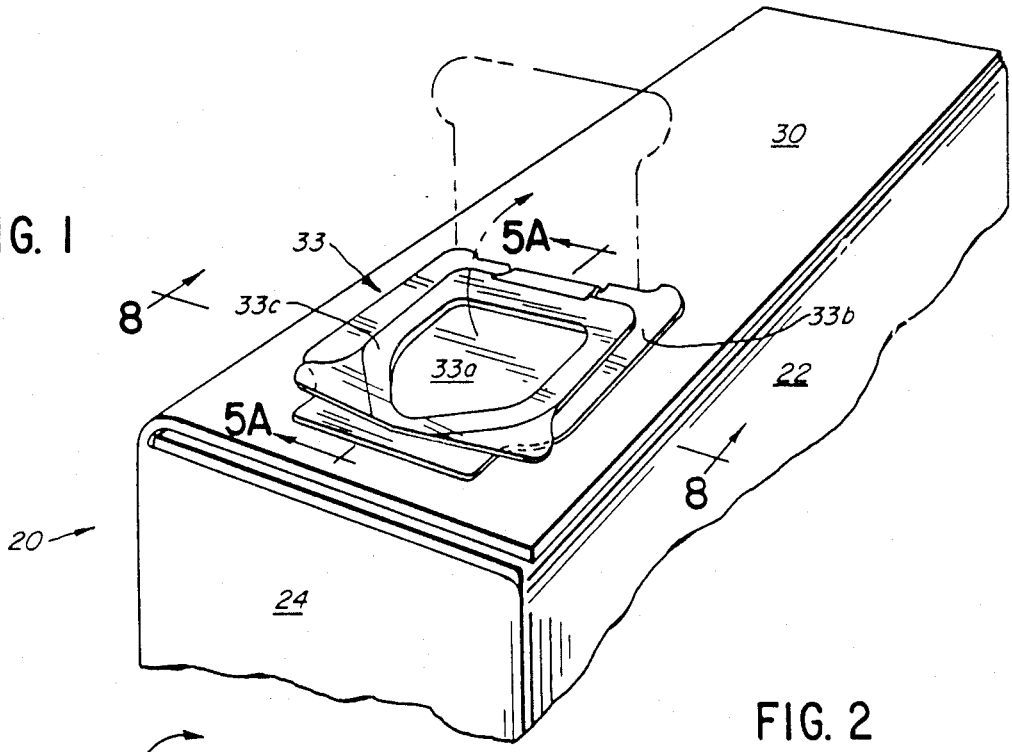
FIG. 2
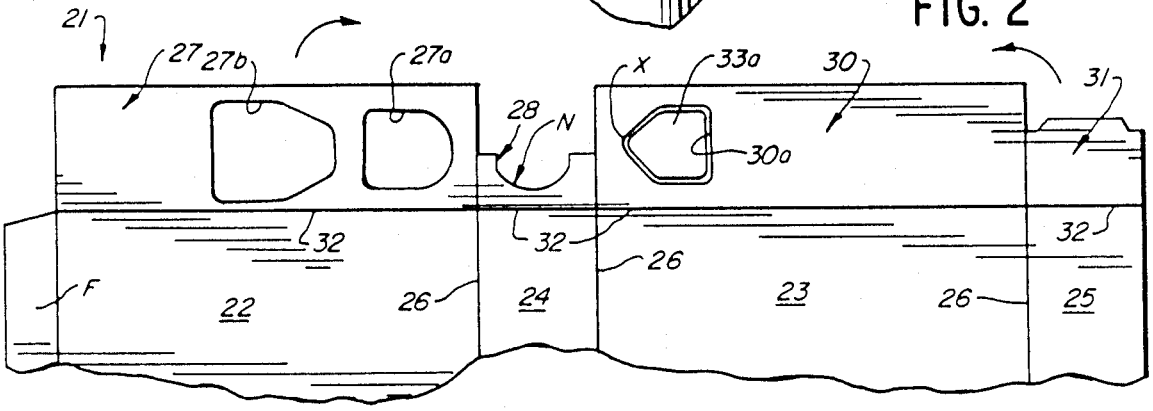
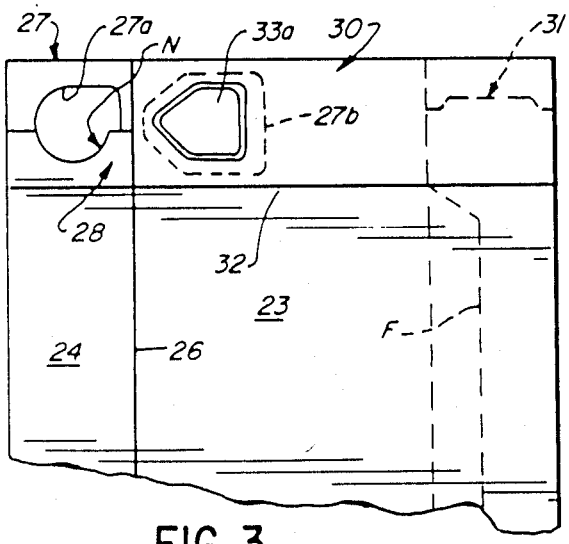
FIG. 3
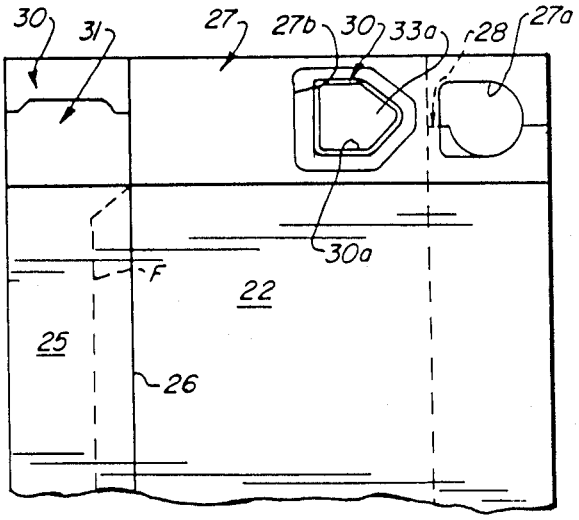
FIG. 4

FIG. 5
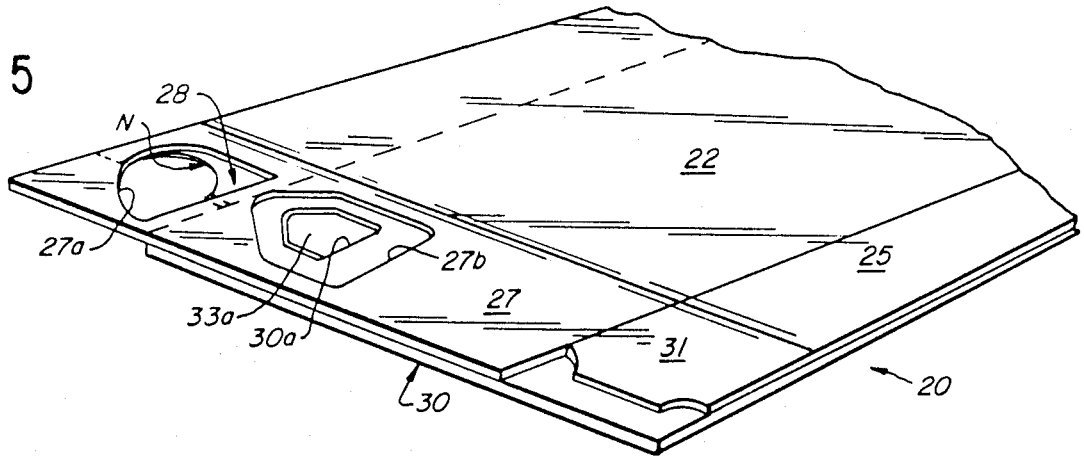
FIG. 5A
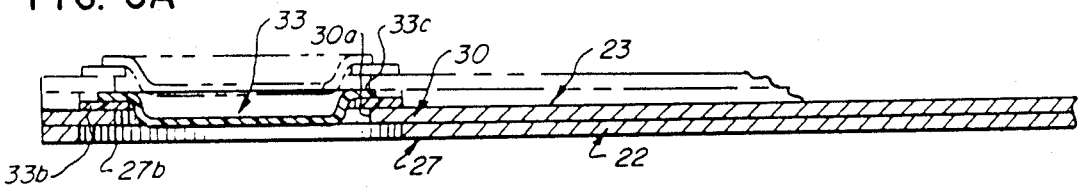
FIG. 6
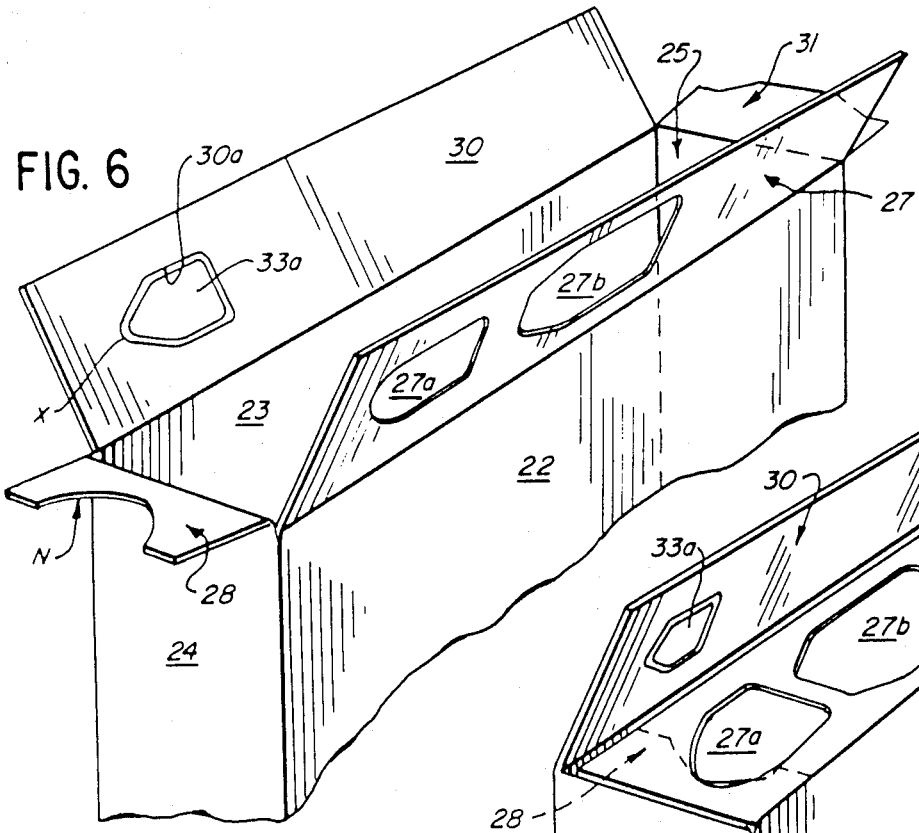
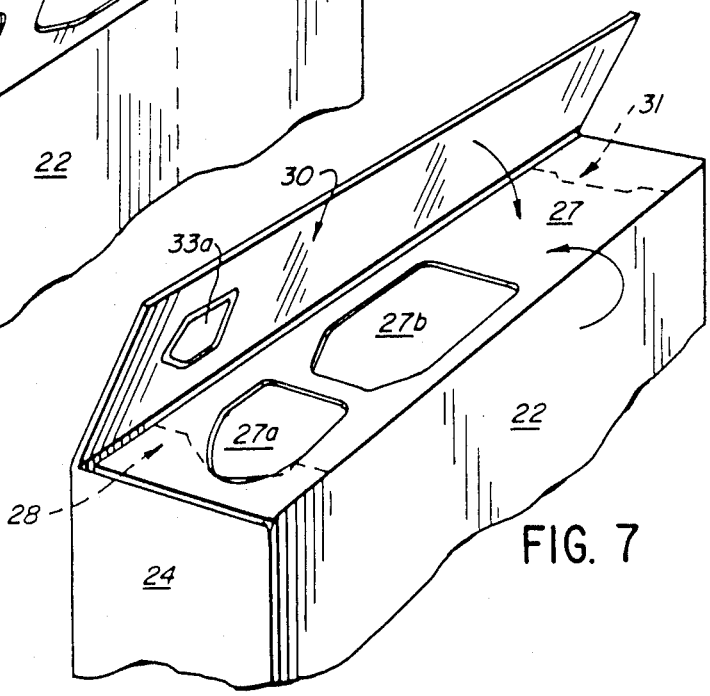
FIG. 7

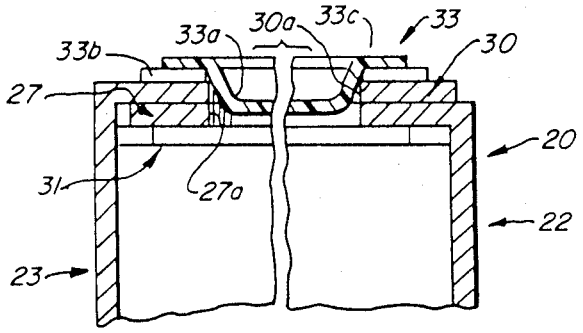
FIG. 8
FIG. 9
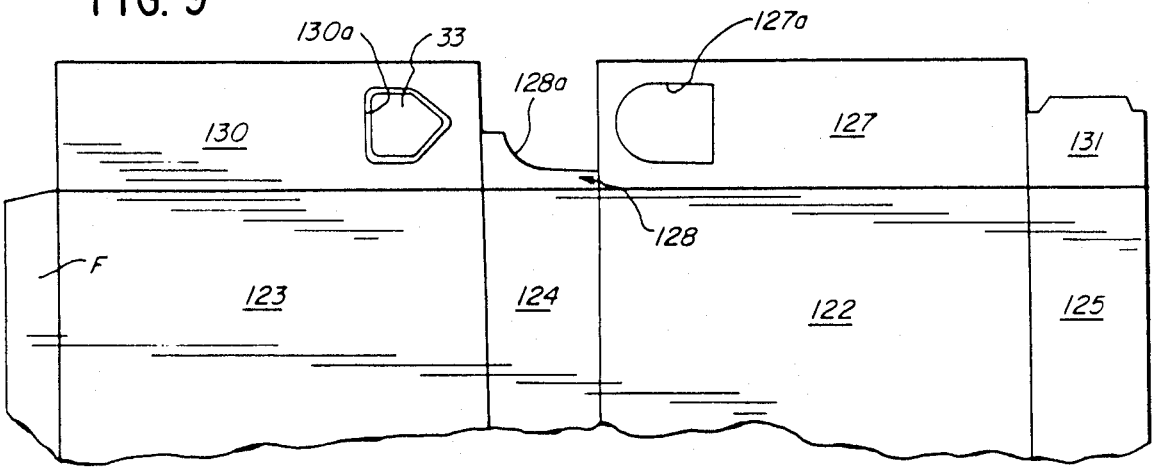
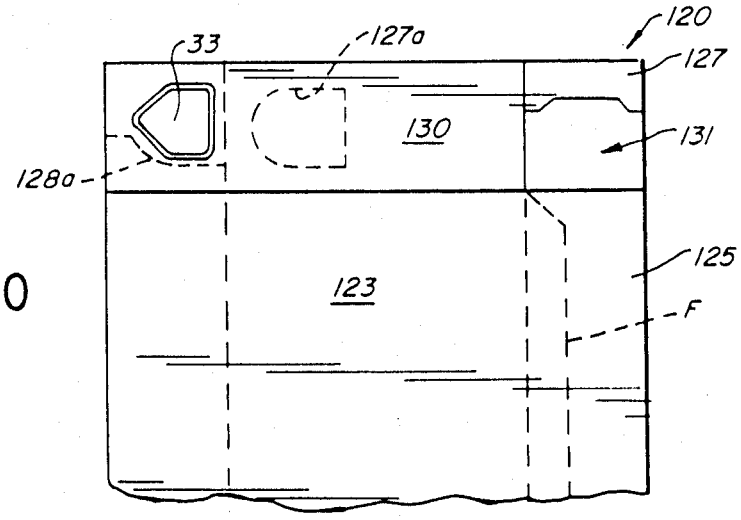
FIG. 10

COLLAPSIBLE FOLDABLE DISPENSING CARTON

BACKGROUND OF THE INVENTION

Collapsible foldable cartons for dispensing granulated products, such as detergents, have been popular for many years; however, because of certain inherent design characteristics they are beset with one or more of the following shortcomings: (a) the carton was of a complex costly design; (b) the carton was difficult and awkward to open and/or reclose; (c) the carton, when in a collapsed mode, could not be readily stacked with like cartons for automatic feeding of individual collapsed cartons into high speed automatic set up and filling equipment commonly utilized in commercial packaging facilities; (d) the carton required the utilization of special forming and/or folding techniques or procedures; and (e) where the carton included a pour spout fitment, the latter could not be readily incorporated in the carton prior to the blank therefor being folded or set up.

SUMMARY OF THE INVENTION

An improved dispensing carton has been provided which avoids all of the aforementioned shortcomings associated with prior cartons of this general type.

The improved dispensing carton is of simple, inexpensive construction and may be readily formed, set up and filled utilizing high speed conventional equipment.

Further and additional advantages possessed by the improved dispensing carton will become apparent from the description, accompanying drawings and appended claims.

In accordance with one embodiment of the invention, an improved collapsible, foldable, dispensing carton is provided having a pair of first wall panels, a pair of second wall panels foldable connected thereto and first and second top closure flaps foldable connected, respectively, to the upper edges of the first and second wall panels. When the carton is in a set up mode, the first wall panels are in an opposed relation and the second wall panels are in an opposed relation and angularly disposed relative to the first wall panels. The closure flaps are adapted to assume an overlapping relation whereby one of the first flaps becomes the outermost flap when the carton is in the set up mode. The outermost flap is provided with a dispensing opening. One of the other flaps disposed beneath the outermost flap is provided with means whereby the dispensing opening is in communication with the interior of the set up carton. A fitment of thin material is mounted on the outermost flap and is provided with a base section affixed to the exposed surface of the outermost flap circumjacent the dispensing opening. The fitment also includes a cover section which is adjustable relative to the base section between open and closed positions. A selected one of the closure flaps disposed beneath the outermost flap, when the carton is in a set up mode, is provided with a cutout which is in registry with the fitment only when the carton is in a collapsed mode.

DESCRIPTION

For a more complete understanding of the invention reference is made to the drawings wherein:

FIG. 1 is a fragmentary perspective top view of one embodiment of the improved dispensing carton shown in a set up mode and with the fitment thereof shown in full lines in a closed position and in phantom lines in an open position.

FIG. 2 is a fragmentary plan view of a blank for forming the carton of FIG. 1 and showing only the upper portions of the wall panels and the top closure flaps connected thereto.

FIG. 3 is a fragmentary front view of the blank of FIG. 2 shown in a folded collapsed mode.

FIG. 4 is a back view of the folded collapsed blank of FIG. 2.

FIG. 5 is a fragmentary perspective end view of the collapsed carton of FIG. 4.

FIG. 5A is a fragmentary sectional view taken along line 5A—5A of FIG. 1 and showing in phantom lines a like carton stacked thereabove.

FIG. 6 is a fragmentary perspective top view of the carton of FIG. 5 partially set up for loading.

FIG. 7 is similar to FIG. 6 but showing the top closure flaps, except the outermost flap, in overlapping relation.

FIG. 8 is an enlarged fragmentary sectional view taken along line 8—8 of FIG. 1.

FIG. 9 is similar to FIG. 2 but of a modified blank.

FIG. 10 is a fragmentary front view of the modified blank of FIG. 9 in a folded collapsed mode.

Referring now to the drawings and more particularly to FIG. 1, a preferred embodiment of the improved foldable dispensing carton 20 is shown which is of a type suitable for accommodating a granulated product, such as a detergent commonly used for washing clothes and the like. Normally, only a portion of the carton contents is used for a given load of articles to be washed. Carton 20 is formed from a blank 21 of boxboard, sometimes referred to as paperboard, commonly utilized in the manufacture of folding cartons. Only the upper portion of the blank 21 is shown in the drawings because the bottom portion is of conventional design and may incorporate overlapping bottom closure flaps of standard design.

Blank 21 includes a pair of opposed side wall panels 22, 23 which are alternately arranged with a pair of narrow end wall panels 24, 25. Adjacent wall panels are interconnected by parallel foldlines 26. Either panel 22 or 25 may be provided with a conventional manufacturer's glue flap F. The corresponding upper edges of panels 22-25 are provided with top closure flaps 27, 28, 30 and 31 which are connected thereto by axially aligned foldlines 32. Flaps 27 and 30 are connected, respectively, to side wall panels 22 and 23 and are frequently referred to as major top closure flaps. Flaps 28 and 31, on the other hand, are connected, respectively, to end wall panels 24 and 25 and are frequently referred to as minor closure flaps. When the carton 20 is in the set up mode, see FIG. 1, the side wall panels 22, 23 are disposed in parallel spaced relation and end wall panels 24, 25 are likewise arranged in parallel spaced relation so as to form a carton having top and bottom closures of rectangular configuration. In some instances the side and end wall panels may be of like shape, thus, forming top and bottom closures of a square configuration. Major top closure flap 30 which becomes the outermost, or exposed, flap when the flaps are folded into overlapping relation, is provided with a dispensing opening 30*a*. The opening is located adjacent the end wall panel 24, when the carton is in a set up mode, see FIG. 1. The perimetric segment of the opening 30*a* closest to end wall panel 24, defines a spout X which helps to control the shape of the product flow from the carton when the latter is tilted downwardly and a fitment 33 mounted on closure flap 30 assumes an open position, as will be described more fully hereinafter.

Top closure flap 28, which is foldable connected to end wall panel 24, has a short length as compared to its width and has the free edge thereof, opposite foldline 32, provided with a centrally disposed notch N. The notch is disposed adjacent the spout X of the dispensing opening 30*a*, when the closure flaps are in overlapping relation.

The second major closure flap 27 foldably connected to side wall panel 22 is provided with an aperture 27*a* which is in registry with the dispensing opening 30*a* when the closure flaps are in overlapping relation. In addition to aperture 27*a*, closure flap 27 is provided with a cutout 27*b*, which is laterally spaced from aperture 27*a* and is in registry with the dispensing opening 30*a* and the fitment 33 when the carton is in a collapsed mode, see FIG. 4. Thus, the cutout 27*b* accommodates a portion or all of the fitment 33*a* and thus, prevents the fitment portion 33*a* from abutting the underlying closure flap 27 and increasing the thickness of the collapsed carton in the vicinity of the fitment. If the cutout 27*b* was not provided in flap 27, the thickness of the collapsed carton might be increased, by an amount, approximating the thickness of the fitment, due to the fitment portion 33*a* abutting the flap 27. Where the overall thickness of the collapsed carton is not substantially uniform throughout, difficulty is frequently encountered in attaining a stable bundle when a plurality of collapsed cartons of like configuration are arranged in a stacked or face to face relation, and particularly, when individual collapsed cartons are to be automatically fed from the bundle into high speed set up, filling and closing equipment.

Various means have heretofore been utilized with prior collapsed cartons to compensate for the increased thickness in the vicinity of the fitment such as rotating approximately 180° successive collapsed cartons in the stack or bundle, or by utilizing embossments, thickened glue seams and/or fluffing the outside scorelines as disclosed in U.S. Pat. No. 4,732,315 issued Mar. 22, 1988. The rotation of successive collapsed cartons requires an extra manipulation or step to occur when the bundles are being formed and involves either manual effort by alert personnel or costly and/or complex automated special equipment. By reason of the cutout 27*b* in closure flap 27 of the improved carton 20 there is no need for rotating successive collapsed cartons in the bundle or stack or utilizing automated special equipment. The centers of aperture 27*a* and cutout 27*b* are laterally spaced apart in flap 27 by an amount which is substantially equal to the width of end wall panel 24 or 25.

When setting up carton 20 from its collapsed mode, FIG. 5, the opposite elongated edges of the collapsed carton are pushed towards one another until the side wall panels 22, 23 are in opposed spaced parallel relation and the end wall panels 24 and 25 assume a similar relation. The bottom closure flaps, not shown, are folded relative to one another to form a closed bottom. When this occurs, the top closure flaps 27, 28, 30 and 31 are disposed in an upright unfolded relation, see FIG. 6, whereupon the carton is ready for filling with the granulated product. Once the proper amount of product has been deposited in the carton through the open top, the top closure flaps are then folded relative to one another as follows: (a) minor flaps 28 and 31 are folded inwardly towards one another; (b) major flap 27 is folded inwardly towards side wall panel 23 so as to overlie and be adhesively affixed to previously folded flaps 28 and 31; and (c) flap 30 with the fitment 33 previously mounted on the exposed surface thereof, is folded inwardly so as to overlie and be adhesively affixed to the previously folded flap 27.

In some instances, the minor flaps 28 and 31 may be folded towards one another so as to overlie flap 227 and be adhesively affixed thereto. In either folding sequence the major closure flap 30 is the outermost, or exposed, flap.

In carton 20, the major top closure flaps 27 and 30 when folded inwardly, span the distance between the opposed side wall panels 22, 23.

The fitment 33 may be of various forms, such as disclosed in pending Stone application Ser. No. 189,301 filed May 2, 1988; or in U.S. Pat. No. 4,732,315. Under any circumstances the fitment is formed of thin, inexpensive plastic material and has a base section 33*b* which is adhesively affixed to the exposed surface of flap 30 circumjacent the dispensing opening 30*a*. Integral with the base section 33*b* is a hinged cover section 33*c* which is adapted to assume either an open or closed position. The cover section 33*c* in an open position is shown in phantom lines in FIG. 1. Formed in the cover section and substantially centered with respect thereto is the depending portion 33*a* (e.g. plug or protuberance), see FIG. 1. The plug is sized so as to snugly fit within the dispensing opening 30*a* when the cover section assumes a closed position with respect to the base section. Besides snugly fitting into the dispensing opening, the plug or other portions of the cover section may be in frictional engagement with the base section.

A modified embodiment of the improved dispensing carton 120 is shown in FIGS. 9 and 10. The structural difference between cartons 20 and 120 is that in carton 120, a cutout 128*a* is provided in minor top closure flap 128, rather than in major closure flap 127. Thus, when carton 120 assumes a collapsed mode as seen in FIG. 10, the fitment 33, which is mounted on major flap 130, will be aligned with the cutout 128*a* formed in minor flap 128. As noted in FIG. 9, major flap 127, which may be either first or second folded when the top closure is formed, is provided with a single opening 127*a*. When all of the closure flaps are in overlapping relation, the dispensing opening 130*a* is in vertical alignment with opening 127*a* and thus, the dispensing opening is in communication with the carton interior.

In either carton construction 20 or 120 the thickness of the fitment 33, when the cover section 33*c* thereof is in a closed position with respect to the base section 33*b*, is compensated by the fact that such fitment is aligned with a cutout 128*a* or 27*b* formed in either flap 128 or 27 when the carton assumes a collapsed mode. Thus, the thickness throughout the collapsed carton will remain substantially uniform and thereby avoid the problem of the thickness, of one side of a bundle of stacked collapsed cartons building up relative to the opposite side of the bundle. The improved carton may be formed, set up and loaded utilizing standard high speed, automatic equipment. No special scoring techniques or procedures are required when the carton blank is being formed. As aforementioned, the size and shape of the fitment may vary from that shown and will depend in part at least on the type of product to be accommodated in the carton.

I claim:

1. A collapsible, folded, dispensing carton comprising a pair of opposed first wall panels; a pair of opposed second wall panels, said pairs being foldably interconnected; a pair of top closure first flaps foldably connected to upper edges of the first wall panels; a pair of top closure second flaps foldably connected to upper edges of the second wall panels, said first and second flaps being in overlapping relation when said carton is in a set up mode whereby one first flap is an outermost flap, the outermost flap being provided with a dispensing opening and one of the other flaps being provided with means whereby the dispensing opening is in communication with the interior of the carton when the latter is in a set up mode; and a fitment of thin material mounted on an exposed surface of the outermost flap and in registry with the dispensing opening, said fitment including a base section affixed to the exposed surface circumjacent the dispensing opening, and a cover section adjustable relative to the base section between open and close positions; said carton, when in a collapsed mode, having a first wall panel and an unfolded first flap connected thereto and a second wall panel and an unfolded second flap connected thereto being in substantially coplanar relation and defining a first plane, and the remaining first and second wall panels and the first and second flaps connected thereto being in substantially coplanar relation and defining a second plane, said planes being disposed in proximate, face to face, substantially parallel relation, the outermost flap being in said first plane and the dispensing opening thereof being opposite a second flap in the second plane, the latter second flap being provided with a cut-out in substantial registry with the said dispensing opening for accommodating a portion of the fitment when the cover section is in the close position and the carton is in the collapsed mode whereby the thickness of the collapsed carton is substantially uniform throughout.

2. The dispensing carton of claim 1 wherein the second wall panels and the top closure second flaps connected thereto are narrower than the first wall panels and the top closure first flaps connected thereto.

3. The dispensing carton of claim 1 wherein the first flap in the second plane is provided with an aperture in registry with the dispensing opening in the outermost first flap only when the closure flaps are in overlapping relation and said carton is in the set up mode.

4. The dispensing carton of claim 2 wherein at least the outermost first flap substantially spans the distance between the opposed first wall panels when the carton is in the set up mode.

* * * * *

UNITED STATES PATENT AND TRADEMARK OFFICE

CERTIFICATE OF CORRECTION

PATENT NO. : 4,880,155

DATED : November 14, 1989

INVENTOR(S) : James L. Stone

It is certified that error appears in the above-identified patent and that said Letters Patent is hereby corrected as shown below:

Column 1, lines 38 and 39 "foldable" should be --foldably--

Column 3, line 5 "foldable" should be --foldably--

Column 4, line 10 "227" should be --27--

Column 5, line 1 "folded" should be --foldable--

Signed and Sealed this

Sixteenth Day of October, 1990

*Attest:*

HARRY F. MANBECK, JR.

*Attesting Officer*

*Commissioner of Patents and Trademarks*